US009145795B2

(12) United States Patent
Lehar et al.

(10) Patent No.: US 9,145,795 B2
(45) Date of Patent: Sep. 29, 2015

(54) SYSTEM AND METHOD OF WASTE HEAT RECOVERY

(71) Applicant: GENERAL ELECTRIC COMPANY, Schenectady, NY (US)

(72) Inventors: Matthew Alexander Lehar, Munich (DE); Matteo Dall'Ara, Cesena (IT)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 13/951,594

(22) Filed: Jul. 26, 2013

(65) Prior Publication Data

US 2014/0352307 A1 Dec. 4, 2014

Related U.S. Application Data

(63) Continuation-in-part of application No. 13/905,897, filed on May 30, 2013, and a continuation-in-part of application No. 13/905,923, filed on May 30, 2013, and a continuation-in-part of application No. 13/905,811, filed on May 30, 2013.

(51) Int. Cl.
*F01K 23/02* (2006.01)
*F01K 25/10* (2006.01)
(Continued)

(52) U.S. Cl.
CPC ..... *F01K 25/103* (2013.01); *F01K 23/08* (2013.01); *F01K 23/10* (2013.01)

(58) Field of Classification Search
CPC ..... F01K 23/02; F01K 23/04
USPC ..... 60/651, 655, 671
See application file for complete search history.

(56) References Cited

U.S. PATENT DOCUMENTS 1,632,575 A * 6/1927 Wilhelm ..... 60/655
2,593,963 A * 4/1952 Biggs ..... 60/655
(Continued)

FOREIGN PATENT DOCUMENTS

CN 102182655 A 9/2011
DE 3616797 A1 11/1987
(Continued)

OTHER PUBLICATIONS

Robb, D., "Supercritical CO2—The Next Big Step?", Turbomachinery International, vol. 53, Issue 5, pp. 22-28, Sep./Oct. 2012.
(Continued)

*Primary Examiner* — Thomas Denion
*Assistant Examiner* — Shafiq Mian
(74) *Attorney, Agent, or Firm* — Andrew J. Caruso

(57) ABSTRACT

A Rankine cycle system useful for the conversion of waste heat into mechanical and/or electrical energy is provided. The system features a novel configuration in which a first closed loop thermal energy recovery cycle comprising a first working fluid stream and a second closed loop thermal energy recovery cycle comprising a second working fluid stream interact but do not mix. The two thermal energy recovery cycles interact thermally via heat exchangers, a first heat exchanger configured to transfer heat from the first working fluid stream to the second working fluid stream, and a second heat exchanger configured to transfer heat from the second working fluid stream to the first working fluid stream. In one or more embodiments, the Rankine cycle system is adapted for the use of supercritical carbon dioxide as the working fluid.

18 Claims, 11 Drawing Sheets

(51) Int. Cl.

| | |
|---|---|
| ***F01K 23/10*** | (2006.01) |
| ***F01K 23/08*** | (2006.01) |

(56) References Cited

U.S. PATENT DOCUMENTS

| | | | | |
|---|---|---|---|---|
| 3,436,911 | A | 4/1969 | Arthur | |
| 3,436,912 | A * | 4/1969 | Squires | 60/39.181 |
| 3,621,653 | A * | 11/1971 | Pacault et al. | 60/651 |
| 3,851,474 | A * | 12/1974 | Heller et al. | 376/378 |
| 4,041,709 | A * | 8/1977 | Rajakovics | 60/655 |
| 4,417,446 | A * | 11/1983 | Nakamoto et al. | 60/641.7 |
| 4,573,321 | A * | 3/1986 | Knaebel | 60/649 |
| 5,535,584 | A | 7/1996 | Janes | |
| 5,628,183 | A | 5/1997 | Rice | |
| 5,754,613 | A | 5/1998 | Hashiguchi et al. | |
| 6,269,626 | B1 | 8/2001 | Kim | |
| 6,347,520 | B1 | 2/2002 | Ranasinghe et al. | |
| 6,405,537 | B1 * | 6/2002 | Wada et al. | 60/778 |
| 6,510,695 | B1 | 1/2003 | Fisher | |
| 7,096,665 | B2 | 8/2006 | Stinger et al. | |
| 7,197,876 | B1 | 4/2007 | Kalina | |
| 7,225,621 | B2 * | 6/2007 | Zimron et al. | 60/651 |
| 8,205,456 | B1 | 6/2012 | Brostmeyer | |
| 8,240,149 | B2 | 8/2012 | Lehar et al. | |
| 8,726,677 | B2 * | 5/2014 | Berson et al. | 62/116 |
| 8,783,035 | B2 * | 7/2014 | Milam et al. | 60/651 |
| 2003/0049139 | A1 | 3/2003 | Coney et al. | |
| 2005/0022499 | A1 | 2/2005 | Belokon et al. | |
| 2006/0105207 | A1 | 5/2006 | Lundberg | |
| 2006/0196187 | A1 * | 9/2006 | Zimron et al. | 60/651 |
| 2008/0010967 | A1 | 1/2008 | Griffin et al. | |
| 2008/0213102 | A1 * | 9/2008 | Bellows | 417/62 |
| 2009/0145103 | A1 | 6/2009 | Nakhamkin | |
| 2009/0193812 | A1 | 8/2009 | Kirzhner | |
| 2009/0241543 | A1 | 10/2009 | Ernst | |
| 2009/0277173 | A1 | 11/2009 | Ernst et al. | |
| 2009/0320477 | A1 * | 12/2009 | Juchymenko | 60/651 |
| 2010/0018207 | A1 * | 1/2010 | Juchymenko | 60/670 |
| 2010/0024421 | A1 | 2/2010 | Litwin et al. | |
| 2010/0242429 | A1 | 9/2010 | Smith | |
| 2011/0005477 | A1 | 1/2011 | Terashima et al. | |
| 2011/0036091 | A1 | 2/2011 | Waterstripe et al. | |
| 2011/0041502 | A1 * | 2/2011 | Zimron et al. | 60/641.15 |
| 2011/0113780 | A1 | 5/2011 | Lehar | |
| 2011/0120129 | A1 | 5/2011 | Frey et al. | |
| 2011/0131996 | A1 | 6/2011 | Lee | |
| 2011/0209474 | A1 * | 9/2011 | Leibowitz | 60/641.1 |
| 2011/0268241 | A1 * | 11/2011 | Keller | 376/317 |
| 2011/0308253 | A1 * | 12/2011 | Ritter | 60/661 |
| 2012/0036850 | A1 | 2/2012 | Ernst et al. | |
| 2012/0131918 | A1 * | 5/2012 | Held | 60/645 |
| 2012/0131920 | A1 * | 5/2012 | Held et al. | 60/650 |
| 2012/0174583 | A1 * | 7/2012 | Lehar | 60/645 |
| 2012/0192560 | A1 | 8/2012 | Ernst et al. | |
| 2012/0255303 | A1 | 10/2012 | Labbe | |
| 2012/0285169 | A1 * | 11/2012 | Freund et al. | 60/643 |
| 2012/0297774 | A1 * | 11/2012 | Uji | 60/670 |
| 2013/0219894 | A1 * | 8/2013 | Bannister et al. | 60/671 |
| 2013/0227947 | A1 * | 9/2013 | Bronicki et al. | 60/651 |
| 2014/0245737 | A1 | 9/2014 | Ikegami et al. | |

FOREIGN PATENT DOCUMENTS

| | | | |
|---|---|---|---|
| JP | 60138214 | A | 7/1985 |
| JP | 2013057305 | A | 3/2013 |

OTHER PUBLICATIONS

PCT Search Report and Written Opinion issued in connection with corresponding Application No. PCT/US2014/037490 on May 6, 2015.

PCT Search Report and Written Opinion issued in connection with corresponding PCT Application No. PCT/US2014/037645 on May 6, 2015.

* cited by examiner

SYSTEM AND METHOD OF WASTE HEAT RECOVERY

RELATED APPLICATIONS

This case is a continuation in part of each of U.S. patent applications having application Ser. Nos. 13/905,897, 13/905,923 and 13/905,811, each of which is incorporated by reference herein in its entirety, each of which was filed on May 30, 2013.

BACKGROUND

The present invention deals with systems and methods for recovering energy from waste heat produced in human activities which consume fuel. In particular, the invention relates to the recovery of thermal energy from underutilized waste heat sources such as combustion turbine exhaust gases.

Human fuel burning activities over the centuries have been a central feature in both the development of human civilization and its continuance. The efficiency with which a fuel can be converted into energy remains a long standing problem however, since much of the energy produced when a fuel is burned cannot be made to do useful work and is lost as waste energy, for example waste heat.

Rankine and other heat recovery cycles have been used innovatively to recover at least some of the energy present in waste heat produced by the combustion of fuel, and much progress has been achieved to date. The achievements of the past notwithstanding, further enhancements to Rankine cycle waste heat recovery systems and methods are needed.

BRIEF DESCRIPTION

In one embodiment, the present invention provides a Rankine cycle system comprising: (a) a first closed loop thermal energy recovery cycle comprising a first working fluid stream; (b) a second closed loop thermal energy recovery cycle comprising a second working fluid stream; (c) a first heat exchanger configured to transfer heat from the first working fluid stream to the second working fluid stream; (d) a second heat exchanger configured to transfer heat from the second working fluid stream to the first working fluid stream; wherein the first closed loop thermal energy recovery cycle further comprises: (i) a heater configured to transfer heat from a first waste heat-containing stream to the first working fluid stream to produce a vaporized first working fluid stream and a second waste heat-containing stream; (ii) a first expander configured to receive the vaporized first working fluid stream and to produce therefrom mechanical energy and an expanded first working fluid stream; (iii) a first condenser configured to cool a heat depleted first working fluid stream and produce therefrom a chilled first working fluid stream; and (iv) a pump configured to pressurize the chilled first working fluid stream; wherein the second closed loop thermal energy recovery cycle further comprises: (v) a second expander configured to expand a vaporized second working fluid stream and to produce therefrom mechanical energy and an expanded second working fluid stream; (vi) a second condenser configured to cool a heat depleted second working fluid stream and to produce therefrom a chilled second working fluid stream; and (vii) a pump configured to pressurize the chilled second working fluid stream; wherein the first heat exchanger is configured to produce the vaporized second working fluid stream and the heat depleted first working fluid stream; and wherein the second heat exchanger is configured to produce a thermally enhanced first working fluid stream and a heat depleted second working fluid stream.

In an alternate embodiment, the present invention provides a Rankine cycle system comprising: (a) a first closed loop thermal energy recovery cycle comprising a first working fluid stream; (b) a second closed loop thermal energy recovery cycle comprising a second working fluid stream; (c) a first heat exchanger configured to transfer heat from the first working fluid stream to the second working fluid stream; (d) a second heat exchanger configured to transfer heat from the second working fluid stream to the first working fluid stream; wherein the first closed loop thermal energy recovery cycle further comprises: (i) a heater configured to transfer heat from a first waste heat-containing stream to the first working fluid stream to produce a vaporized first working fluid stream and a second waste heat-containing stream; (ii) a first expander configured to receive the vaporized first working fluid stream and to produce therefrom mechanical energy and an expanded first working fluid stream; (iii) a first condenser configured to cool a heat depleted first working fluid stream and produce therefrom a chilled first working fluid stream; and (iv) a pump configured to pressurize the chilled first working fluid stream; wherein the second closed loop thermal energy recovery cycle further comprises: (v) a second expander configured to expand a vaporized second working fluid stream and to produce therefrom mechanical energy and an expanded second working fluid stream; (vi) a second condenser configured to cool a heat depleted second working fluid stream and to produce therefrom a chilled second working fluid stream; (vii) a pump configured to pressurize the chilled second working fluid stream; (viii) a second-working-fluid-stream splitter configured to divide the expanded second working fluid stream into a first portion of the expanded second working fluid stream and a second portion of the expanded second working fluid stream; and (ix) a second-working-fluid-stream combiner configured to combine a heat depleted first portion of the second working fluid stream with heat depleted second portion of the second working fluid stream; wherein the first heat exchanger is configured to produce the vaporized second working fluid stream, the heat depleted first working fluid stream and a heat depleted first portion of the second working fluid stream; and wherein the second heat exchanger is configured to produce a thermally enhanced first working fluid stream and a heat depleted second portion of the second working fluid stream.

In an alternate embodiment, the present invention provides a Rankine cycle system comprising: (a) a first closed loop thermal energy recovery cycle comprising a first working fluid stream; (b) a second closed loop thermal energy recovery cycle comprising a second working fluid stream; (c) a first heat exchanger configured to transfer heat from the first working fluid stream to the second working fluid stream; (d) a second heat exchanger configured to transfer heat from the second working fluid stream to the first working fluid stream; wherein the first closed loop thermal energy recovery cycle further comprises: (i) a first heater configured to transfer heat from a first waste heat-containing stream to the first working fluid stream to produce a vaporized first working fluid stream and a second waste heat-containing stream; (ii) a first expander configured to receive the vaporized first working fluid stream and to produce therefrom mechanical energy and an expanded first working fluid stream; (iii) a first condenser configured to cool a heat depleted first working fluid stream and produce therefrom a chilled first working fluid stream; and (iv) a pump configured to pressurize the chilled first working fluid stream; (v) at least one working fluid stream splitter configured to divide the chilled first working fluid stream into a first portion and a second portion; (vi) a second heater configured to transfer heat from the second waste heat-containing stream to the first portion of the first working fluid stream to produce a thermally enhanced first portion of the first working fluid stream and a third waste heat-containing stream; and (vii) at least one working fluid stream combiner configured to combine two thermally enhanced streams of the first working fluid; wherein the second closed loop thermal energy recovery cycle further comprises: (viii) a second expander configured to expand a vaporized second working fluid stream and to produce therefrom mechanical energy and an expanded second working fluid stream; (ix) a second condenser configured to cool a heat depleted second working fluid stream and to produce therefrom a chilled second working fluid stream; and (x) a pump configured to pressurize the chilled second working fluid stream; wherein the first heat exchanger is configured to produce the vaporized second working fluid stream and the heat depleted first working fluid stream; and wherein the second heat exchanger is configured to produce a thermally enhanced second portion of the first working fluid stream and a heat depleted second working fluid stream.

In yet another embodiment, the present invention provides a method of recovering thermal energy using a Rankine cycle system comprising: (a) transferring heat from a first waste heat-containing stream to a first working fluid stream contained within a first closed loop thermal energy recovery cycle to produce thereby a vaporized first working fluid stream and a second waste heat-containing stream; (b) expanding the vaporized first working fluid stream to produce thereby mechanical energy and an expanded first working fluid stream; (c) transferring heat from the expanded first vaporized working fluid stream to a second working fluid stream contained within a second closed loop thermal energy recovery cycle to produce thereby a vaporized second working fluid stream and a heat depleted first working fluid stream; (d) expanding the vaporized second working fluid stream to produce thereby mechanical energy and an expanded second working fluid stream; and (e) transferring heat from the expanded second working fluid stream to a chilled first working fluid stream, to produce thereby a thermally enhanced first working fluid stream and a second heat depleted second working fluid stream.

BRIEF DESCRIPTION OF THE DRAWING FIGURES

Various features, aspects, and advantages of the present invention will become better understood when the following detailed description is read with reference to the accompanying drawings in which like characters may represent like parts throughout the drawings. Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION

Figure 1:
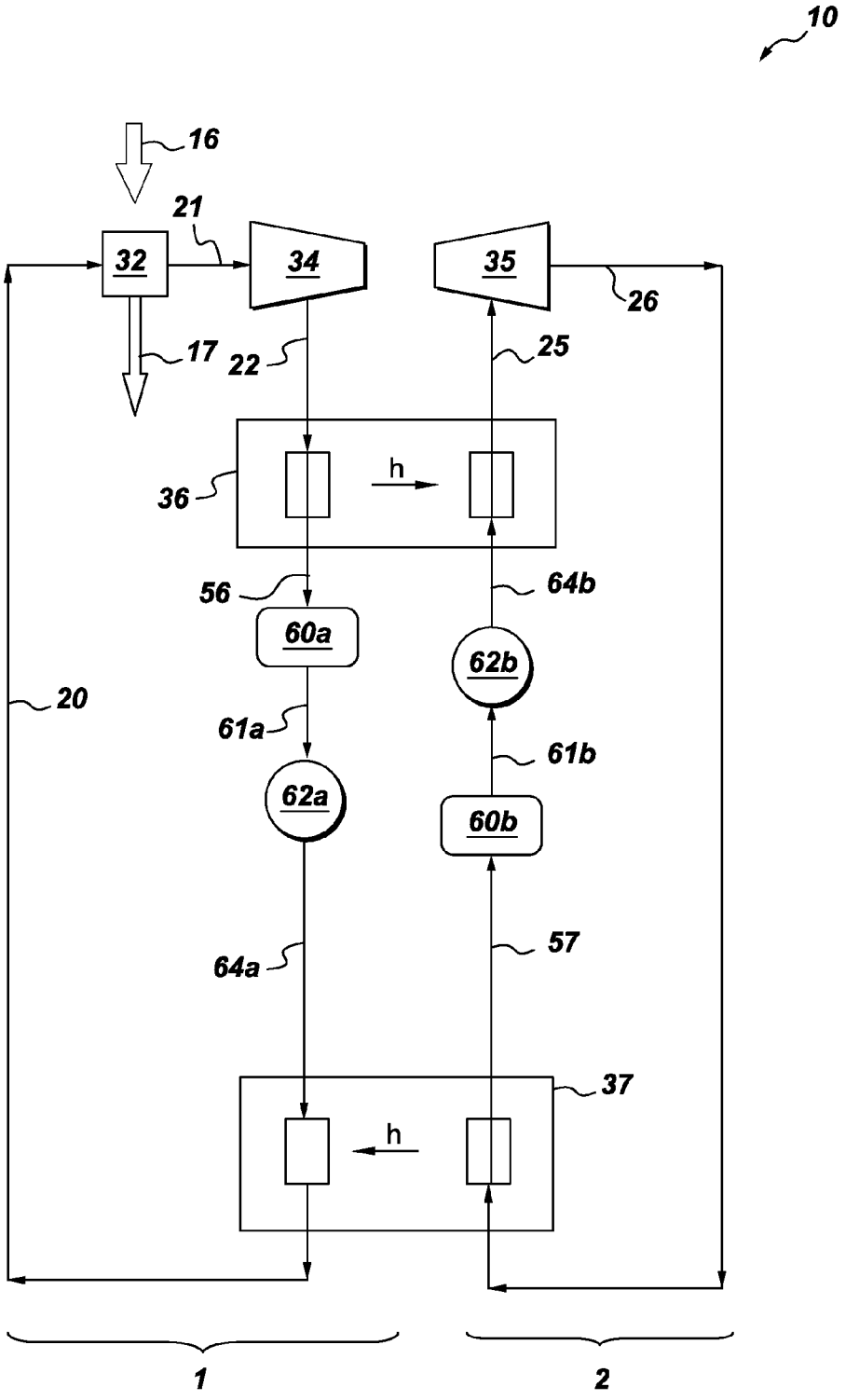
FIG. 1 represents a first embodiment of the present invention.

In the following specification and the claims, which follow, reference will be made to a number of terms, which shall be defined to have the following meanings.

The singular forms "a", "an", and "the" include plural referents unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the expression "configured to" describes the physical arrangement of two or more components of a Rankine cycle system required to achieve a particular outcome. Thus the expression "configured to" can be used interchangeably with expression "arranged such that", and those of ordinary skill in the art and having read this disclosure will appreciate the various arrangements of Rankine cycle system components intended based upon the nature of the outcome recited. The expression "configured to accommodate" in reference to a working fluid of a Rankine cycle system, means that the Rankine cycle system is constructed of components which when combined can safely contain the working fluid during operation.

As noted, in one embodiment, the present invention provides a Rankine cycle system useful for recovering energy from waste heat sources, for example the heat laden exhaust gas stream from a combustion turbine. The Rankine cycle system converts at least a portion of the thermal energy present in the waste heat source into mechanical energy which may be used in various ways. For example, the mechanical energy produced from the waste heat may be used to drive a generator, an alternator, or other suitable device capable of converting mechanical energy into electrical energy. In one or more embodiments the Rankine cycle system provided by the present invention comprises a plurality of devices configured to convert mechanical energy produced by the Rankine cycle system into electrical energy. For example a Rankine cycle system provided by the present invention might comprise two or more generators, or a generator and an alternator. In an alternate embodiment, the Rankine cycle system provided by the present invention coverts thermal energy contained in a working fluid into mechanical energy and employs at least a portion of the mechanical energy produced to power a component of the system, for example a pump used to pressurize the working fluid.

In one or more embodiments, the Rankine cycle system provided by the present invention comprises a heater configured to transfer heat from a first waste heat-containing stream to a first working fluid stream to produce a vaporized first working fluid stream and a second waste heat-containing stream. The waste heat-containing stream may be any waste heat-containing gas, liquid, fluidized solid, or multiphase fluid from which heat may be recovered. As used herein, the term "heater" describes a device which brings a waste heat source such as a waste heat-containing stream into thermal contact with the working fluid of a Rankine cycle system, such that heat is transferred from the waste heat source to the working fluid without bringing the waste heat source into direct contact with the working fluid, i.e. the waste heat source does not mix with the working fluid. Such heaters are commercially available and are known to those of ordinary skill in the art. For example, the heater can be a duct through which a waste heat-containing stream may be passed, such as that disclosed in United States Patent Application US2011-0120129 A1 filed Nov. 24, 2009, and which is incorporated by reference herein in its entirety. The working fluid may be brought into thermal contact with the waste heat-containing stream by means of tubing through which the working fluid is passed, the tubing being disposed within the duct. A flowing working fluid enters the portion of the tubing disposed within the duct at a first working fluid temperature, receives heat from the waste heat-containing stream flowing through the duct, and exits the tubing within the duct at a second working fluid temperature which is higher than the first working fluid temperature. The waste heat-containing stream enters the duct at a first waste heat-containing stream temperature, and having transferred at least a portion of its thermal energy to the working fluid, exits the duct at a second waste heat-containing stream temperature which is lower than the first waste heat-containing stream temperature.

Figure 5:
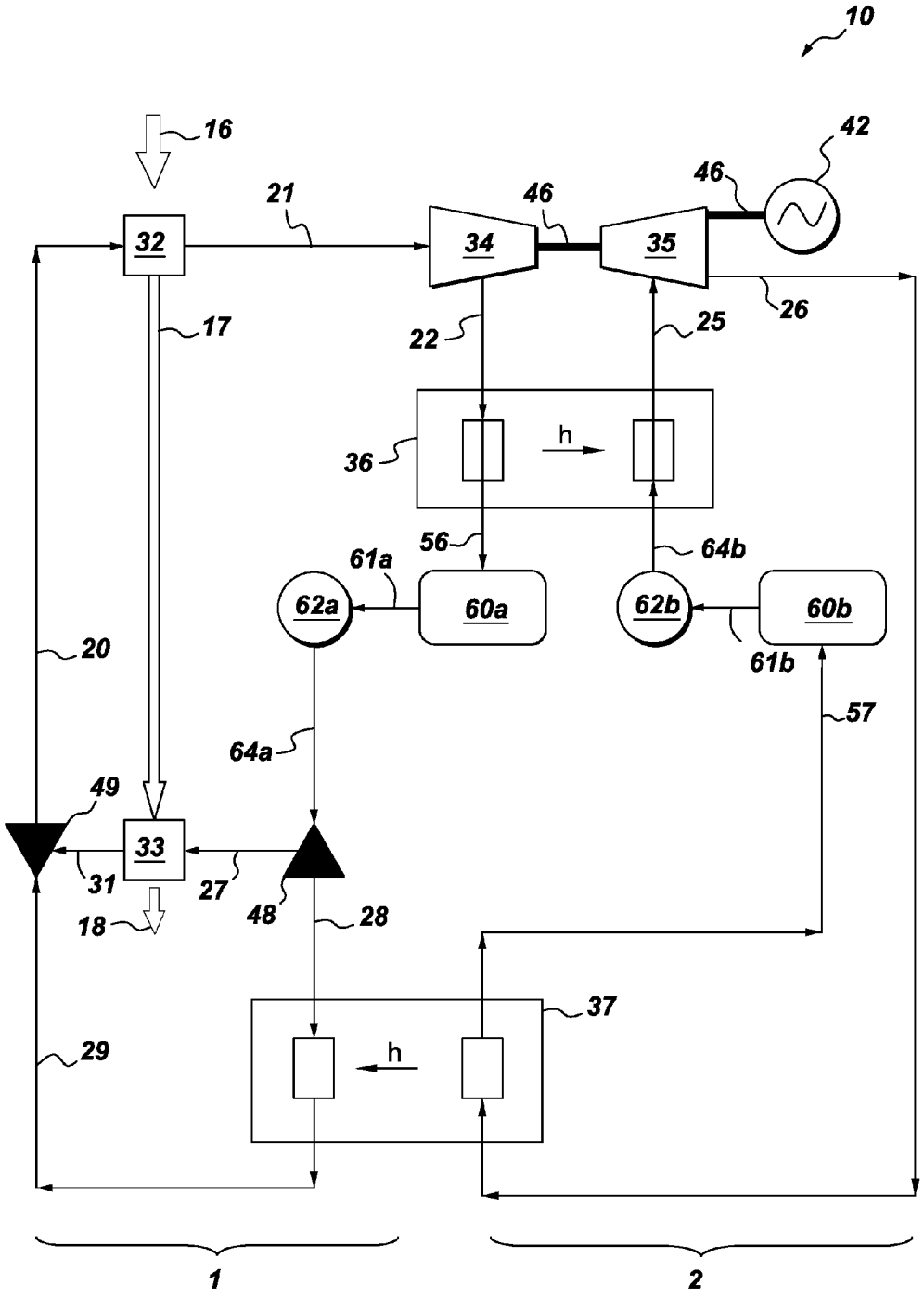
FIG. 5 represents a fifth embodiment of the present invention.

As used herein, the term "heater" is reserved for devices which are configured to transfer heat from a waste heat source such as a waste heat-containing stream to a working fluid, and are not configured to exchange heat between a first working fluid stream and a second working fluid stream. Heaters are distinguished herein from heat exchangers which are configured to allow heat exchange between a first working fluid stream and a second working fluid stream. This distinction is illustrated in FIG. 5 and elsewhere in this disclosure in which heaters 32 and 33 transfer heat from a waste heat-containing stream; waste heat-containing streams 16 and 17 respectively, to working fluid streams 20 and 27 respectively. Those of ordinary skill in the art will appreciate that numbered system components 36 and 37 shown in FIG. 5 are configured to exchange heat between a first working fluid stream and a second working fluid stream and qualify as heat exchangers as defined herein, and do not qualify as "heaters" as defined herein.

Suitable heaters which may be used in accordance with one or more embodiments of the invention include duct heaters as noted, fluidized bed heaters, shell and tube heaters, plate heaters, fin-plate heaters, and fin-tube heaters.

Suitable heat exchangers which may be used in accordance with one or more embodiments of the invention include shell and tube type heat exchangers, printed circuit heat exchangers, plate-fin heat exchangers and formed-plate heat exchangers. In one or more embodiments of the present invention the Rankine cycle system comprises at least one heat exchanger of the printed circuit type.

The working fluid used according to one or more embodiments of the invention may be any working fluid suitable for use in a Rankine cycle system, for example carbon dioxide. Additional suitable working fluids include, water, nitrogen, hydrocarbons such as cyclopentane, organic halogen compounds, and stable inorganic fluids such as $SF_6$. In one embodiment, the working fluid is carbon dioxide which at one or more locations within the Rankine cycle system may be in a supercritical state.

The Rankine cycle systems provided by the present invention comprise two distinct closed loop thermal energy recovery cycles each of which is configured to accommodate a working fluid. The first such closed loop thermal energy recovery cycle is configured to accommodate a first working fluid stream and the second closed loop thermal energy recovery cycle is configured to accommodate a second working fluid stream. Within each closed loop thermal energy recovery cycle the working fluid is variously heated, expanded, chilled, and pressurized. Heat is exchanged between the first working fluid stream contained within the first closed loop thermal energy recovery cycle and the second working fluid stream contained within the second closed loop thermal energy recovery cycle in heat exchangers which facilitate the flow of heat from the first working fluid stream to the second working fluid stream in the first heat exchanger and a reverse flow of heat (i.e. the second working fluid stream heats the first working fluid stream) in the second heat exchanger. While the first working fluid stream and the second working fluid stream are essentially single fluid streams contained within two separate closed loop cycles, it is useful to regard each working fluid stream as being made up of a plurality of streams representing the various states of the working fluid (e.g. vaporized, expanded, chilled, pressurized, heat depleted, thermally enhanced, split, combined) within the system as a means of specifying the overall configuration of the Rankine cycle system. Thus, for example, a first working fluid stream enters a heater where it picks up waste heat from a waste heat source and is transformed from a first working fluid stream into a first vaporized working fluid stream.

The expression "vaporized working fluid" when applied to a highly volatile working fluid such as carbon dioxide which has a boiling point of −56° C. at 518 kPa, simply means a gaseous working fluid which is hotter than it was prior to its passage through a heater or heat exchanger. It follows then, that the term vaporized as used herein need not connote the transformation of the working fluid from a liquid state to a gaseous state. A vaporized working fluid stream may be in a supercritical state when produced by passage through a heater and/or a heat exchanger of a Rankine cycle system provided by the present invention.

Similarly the terms "chilled" or "pressurized" when applied to a working fluid need not connote a working fluid in a liquid state. In the context of a working fluid such as carbon dioxide, a chilled working fluid stream is simply a working fluid stream which has been passed through a fluid condenser unit. Similarly a pressurized working fluid stream is simply a working fluid stream which has passed through a fluid pressurizing device such as a pump or a compressor. Thus, the terms "chilled working fluid stream" and "pressurized working fluid stream" may in some embodiments actually refer to a working fluid stream in a gaseous state or supercritical state. Suitable condensing or cooling units which may be used in accordance with one or more embodiments of the invention include fin-tube condensers and plate-fin condenser/coolers. In one or more embodiments, the present invention provides a Rankine cycle system comprising a single working fluid condenser unit common to both the first closed loop thermal energy recovery cycle and the second closed loop thermal energy recovery cycle. In an alternate set of embodiments, the present invention provides a Rankine cycle system comprising a plurality of working fluid condensers configured to operate within a plurality of closed loop thermal energy recovery cycles.

The term "expanded" when applied to a working fluid describes the condition of a working fluid stream following its passage through an expander or an expansion valve. As will be appreciated by those of ordinary skill in the art, some of the energy contained within a vaporized working fluid is converted to mechanical energy as it passes through an expander. Suitable expanders which may be used in accordance with one or more embodiments of the invention include axial- and radial-type expanders.

In one or more embodiments the Rankine cycle system provided by the present invention further comprises a device configured to convert mechanical energy into electrical energy, such as a generator or an alternator, which may be driven using the mechanical energy produced in the expander. In one or more alternate embodiments, the Rankine cycle system comprises a plurality of devices configured to convert mechanical energy produced in the expander into electric power. Mechanical coupling between the expanders and such energy conversion devices can be achieved using art-known techniques. For example, gearboxes and/or drive shafts may be used to connect the expansion devices with one or more generators and/or alternators. In one embodiment, a transformer and/or an inverter may be used to condition electrical power produced by a generator and/or alternator of the Rankine cycle system.

Turing now to the figures, the figures represent essential features of Rankine cycle systems provided by the present invention. The various flow lines indicate the direction of flow of waste heat-containing streams and working fluid streams through the various components of the Rankine cycle system. As will be appreciated by those of ordinary skill in the art, waste heat-containing streams and working fluid streams are appropriately confined in the Rankine cycle system. Thus, for example, each of the lines indicating the direction of flow of the working fluid represents a conduit integrated into the Rankine cycle system. Similarly, large arrows indicating the flow of waste heat-containing streams are meant to indicate streams flowing within appropriate conduits (not shown). In Rankine cycle systems configured to use carbon dioxide as the working fluid, conduits and equipment may be selected to safely utilize supercritical carbon dioxide using Rankine cycle system components known in the art.

Referring to FIG. 1, the figure represents components of a Rankine cycle system 10 provided by the present invention and comprising a first closed loop thermal energy recovery cycle 1 comprising a first working fluid stream (shown variously as numbered elements 20, 21, 22, 56, 61*a*, and 64*a*) and a second closed loop thermal energy recovery cycle 2 comprising a second working fluid stream (shown variously as numbered figure elements 25, 26, 57, 61*b* and 64*b*). In the embodiment shown, the Rankine cycle system comprises a first heat exchanger 36 configured to transfer heat from the first working fluid stream to the second working fluid stream, and a second heat exchanger 37 configured to transfer heat from the second working fluid stream to the first working fluid stream, the direction of heat flow in each case being indicated by an arrow surmounted by the letter "h". Closed loop thermal energy recovery cycle 1 comprises a heater 32 configured to bring a first waste heat-containing stream 16 into thermal contact with the first working fluid stream in state 20 and to produce thereby a second waste heat-containing stream 17 and a vaporized first working fluid stream 21, which is directed to first expander 34 configured to convert at least a portion of the thermal energy contained in vaporized working fluid stream 21 into mechanical energy, which may be used in various ways known to those of ordinary skill in the art. From first expander 34 the first working fluid stream is directed to the first heat exchanger 36 as expanded first working fluid stream 22 which loses additional heat while in thermal contact with the second working fluid stream in the form of pressurized second working fluid stream 64*b*. The first working fluid stream exits the first heat exchanger as heat depleted first working fluid stream 56, which is directed to first condenser 60*a* to provide chilled first working fluid stream 61*a*, which is pressurized in first pump 62*a* to produce pressurized first working fluid stream 64*a*. Working fluid stream 64*a* is then directed to second heat exchanger 37 where it gains heat from the second working fluid stream and becomes thermally enhanced working fluid stream 20 which is returned to first heater 32 and completes the thermal energy recovery cycle.

Still referring to FIG. 1, second closed loop thermal energy recovery cycle 2 comprises a second expander 35 configured to expand vaporized second working fluid stream 25 and to produce useful mechanical energy and expanded second working fluid stream 26 thereby. Expanded second working fluid stream 26 is directed to second heat exchanger 37 where it gives up heat to the first working fluid stream and becomes heat depleted second working fluid stream 57, which is chilled in second condenser 60*b* to produce chilled second working fluid stream 61*b*, which is pressurized in second pump 62*b* to produce pressurized second working fluid stream 64*b*, which is introduced into first heat exchanger 36 where it is transformed into vaporized second working fluid stream 25 and completes the thermal energy recovery cycle.

Still referring to FIG. 1, those of ordinary skill in the art will appreciate that heat exchangers 36 and 37 are shared by both the first closed loop thermal energy recovery cycle 1 and the second closed loop thermal energy recovery cycle 2. In the interest of clarity and for convenience in describing the invention, the two heat exchangers are treated as independent Rankine cycle system components even though each is integrated into both of the first closed loop thermal energy recovery cycle 1 and the second closed loop thermal energy recovery cycle 2.

Figure 2:
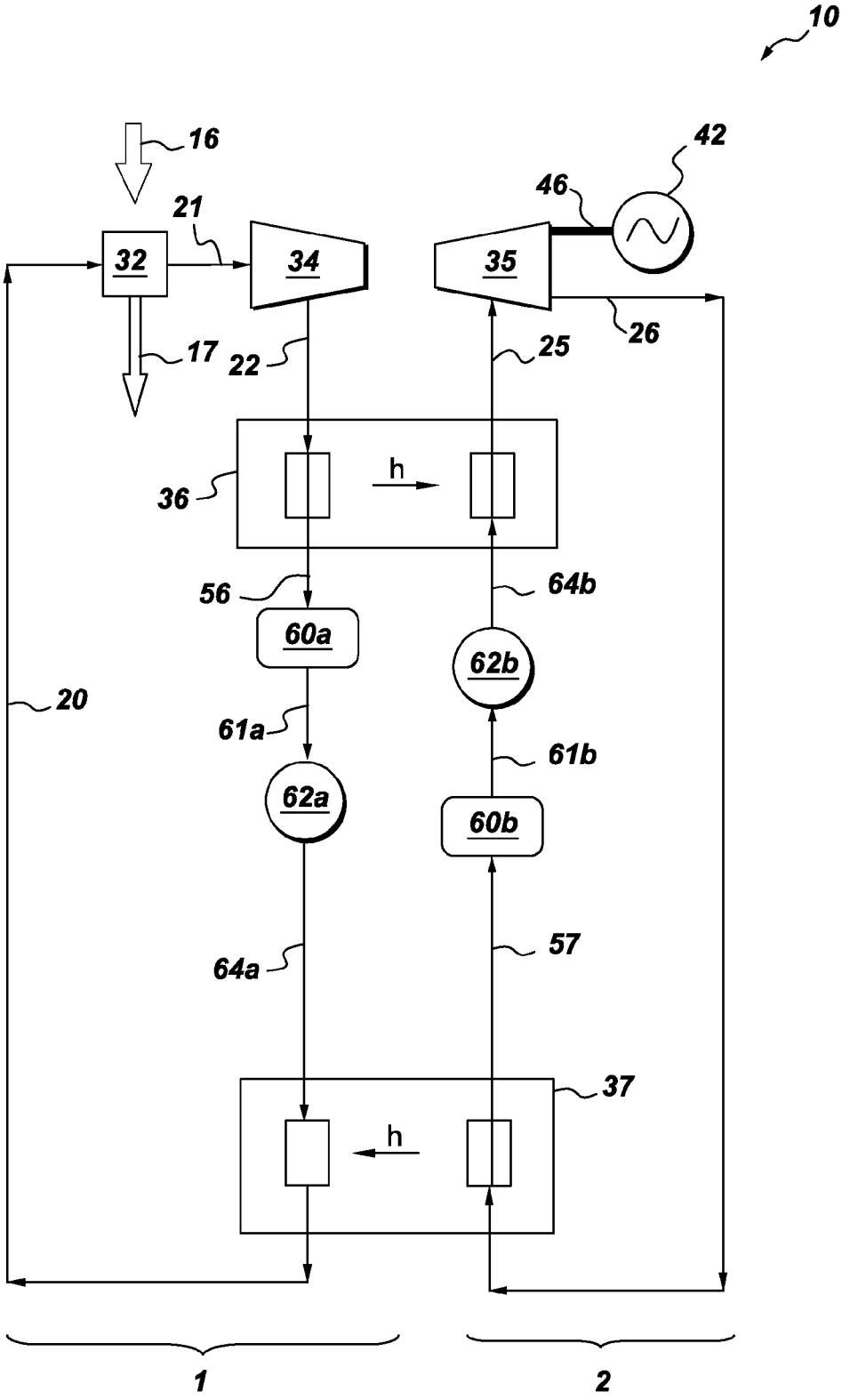
FIG. 2 represents a second embodiment of the present invention.

Referring to FIG. 2, the figure represents a Rankine cycle system 10 as in FIG. 1 and further comprising a mechanical energy conversion device 42 configured to convert mechanical energy produced by second expander 35 into electrical energy. In the embodiment shown, mechanical energy is transferred via drive shaft 46 from second expander 35 to device 42. In one embodiment, the mechanical energy conversion device is an alternator. In an alternate embodiment, the mechanical energy conversion device is a generator. Electrical energy produced by conversion device 42 may be used for various purposes including powering other components of the Rankine cycle system, for example pumps 62*a* and 62*b*, and condensers comprising an electrically powered refrigeration unit.

Figure 3:
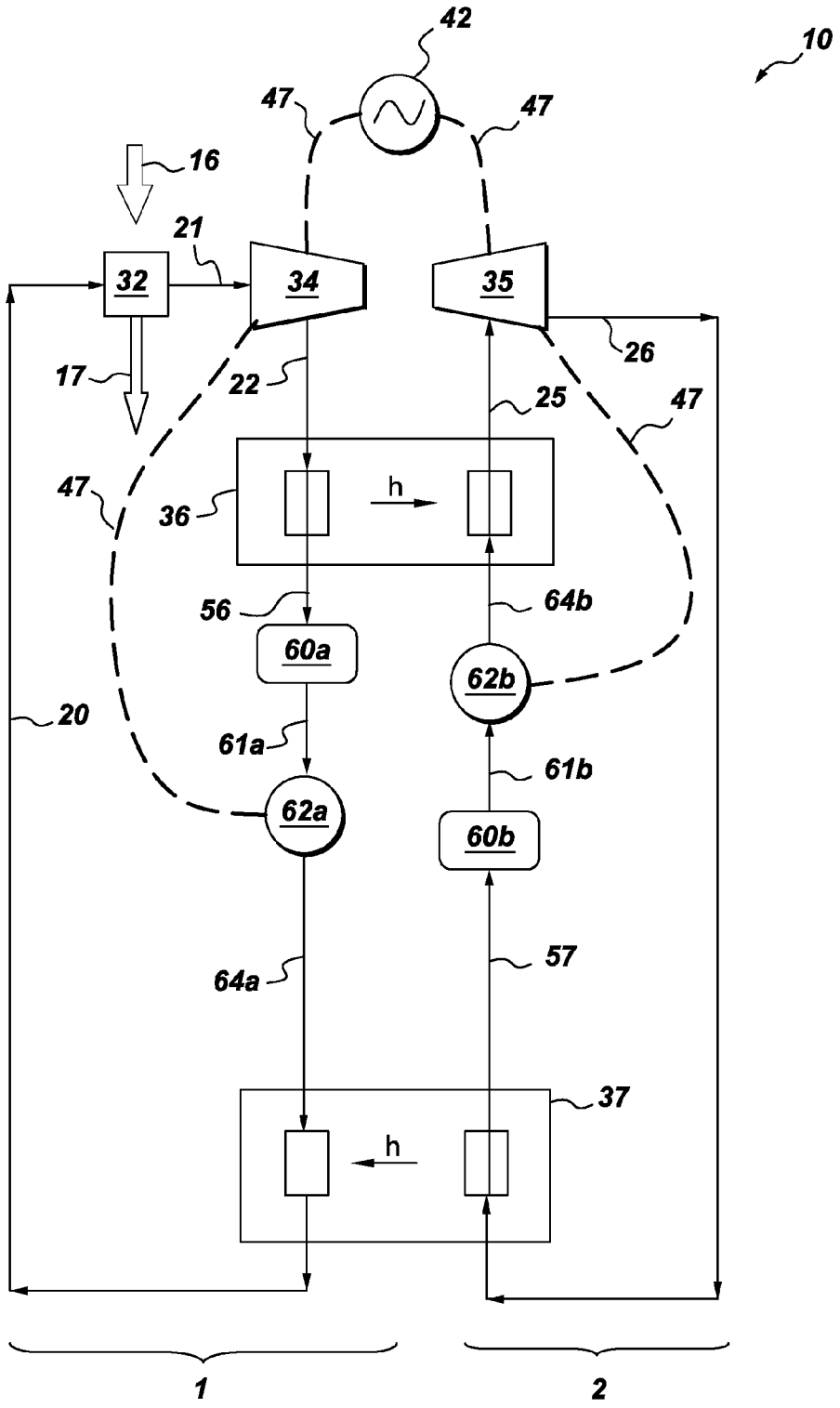
FIG. 3 represents a third embodiment of the present invention.

Referring to FIG. 3, the figure represents a Rankine cycle system 10 configured as in FIG. 1 and further comprising a mechanical energy conversion device 42 coupled to each of first expander 34 and second expander 35 via mechanical coupling 47. Mechanical coupling 47 may be any suitable means of transferring mechanical energy such as a gearbox, a drive shaft, a belt, or a chain. In the embodiment shown, mechanical energy is also provided to first and second pumps 62*a* and 62*b*, again by means of mechanical couplings 47.

Figure 4:
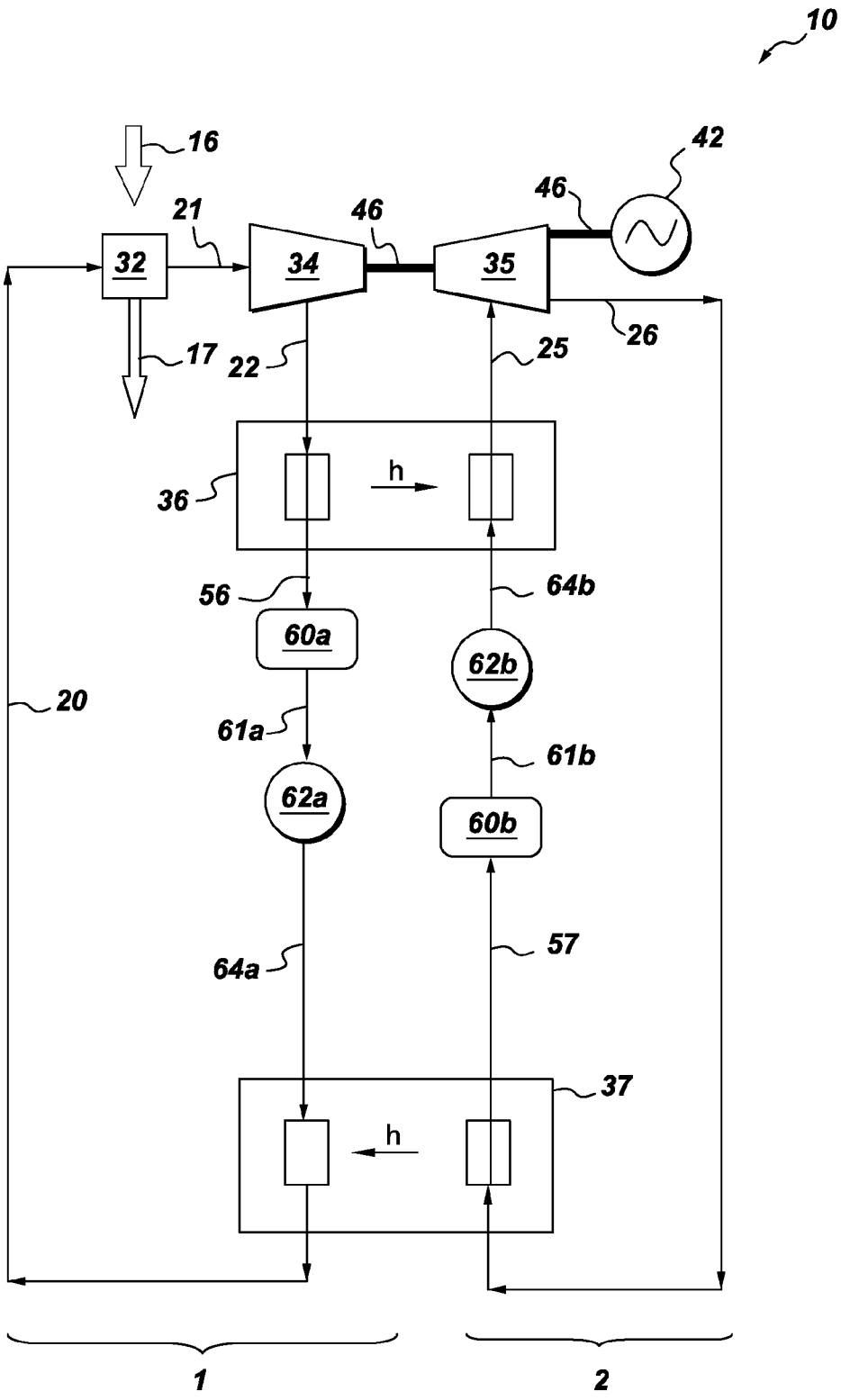
FIG. 4 represents a fourth embodiment of the present invention.

Referring to FIG. 4, the figure represents a Rankine cycle system 10 configured as in FIG. 1 and further comprising a mechanical energy conversion device 42 coupled to both the first expander 34 and the second expander 35 via a common drive shaft 46.

Referring to FIG. 5, the figure represents a Rankine cycle system 10 configured as in FIG. 4 and further comprising a second heater 33, a working fluid stream splitter 48 and a working fluid stream combiner 49 as components of first closed loop thermal energy recovery cycle 1. The presence of the additional heater 33 allows the extraction of additional heat from second waste heat-containing stream 17 and the conversion of such additional heat into useful electrical energy. Thus, first working fluid stream 20 is vaporized in first heater 32 and expanded in first expander 34 to produce mechanical energy, which is conveyed by means of drive shafts 46 to mechanical energy conversion device 42 where it is converted into electrical energy. The expanded first working fluid stream 22 comprises sufficient heat to produce vaporized second working fluid stream 25 by transferring heat to pressurized second working fluid stream 64*b* in first heat exchanger 36. The first working fluid stream exits heat exchanger 36 as heat depleted first working fluid stream 56, which is then further cooled in first condenser 60*a* and pressurized in first pump 62*a*. The resultant chilled, pressurized first working fluid stream 64*a* is then divided at working fluid stream splitter 48 into a first portion 27 and a second portion 28 of the chilled, pressurized working fluid stream. First portion 27 is brought into thermal contact with second waste heat-containing stream 17 in second heater 33 where it gains heat and becomes thermally enhanced first working fluid stream 31. Second portion 28 is introduced into second heat exchanger 37 where it gains heat from expanded second working fluid stream 26 and becomes thermally enhanced first working fluid stream 29. The thermally enhanced working fluid streams 29 and 31 are combined at working fluid stream combiner 49 to provide first working fluid stream 20 which is reintroduced into first heater 32 and completes the thermal energy recovery cycle.

Figure 6:
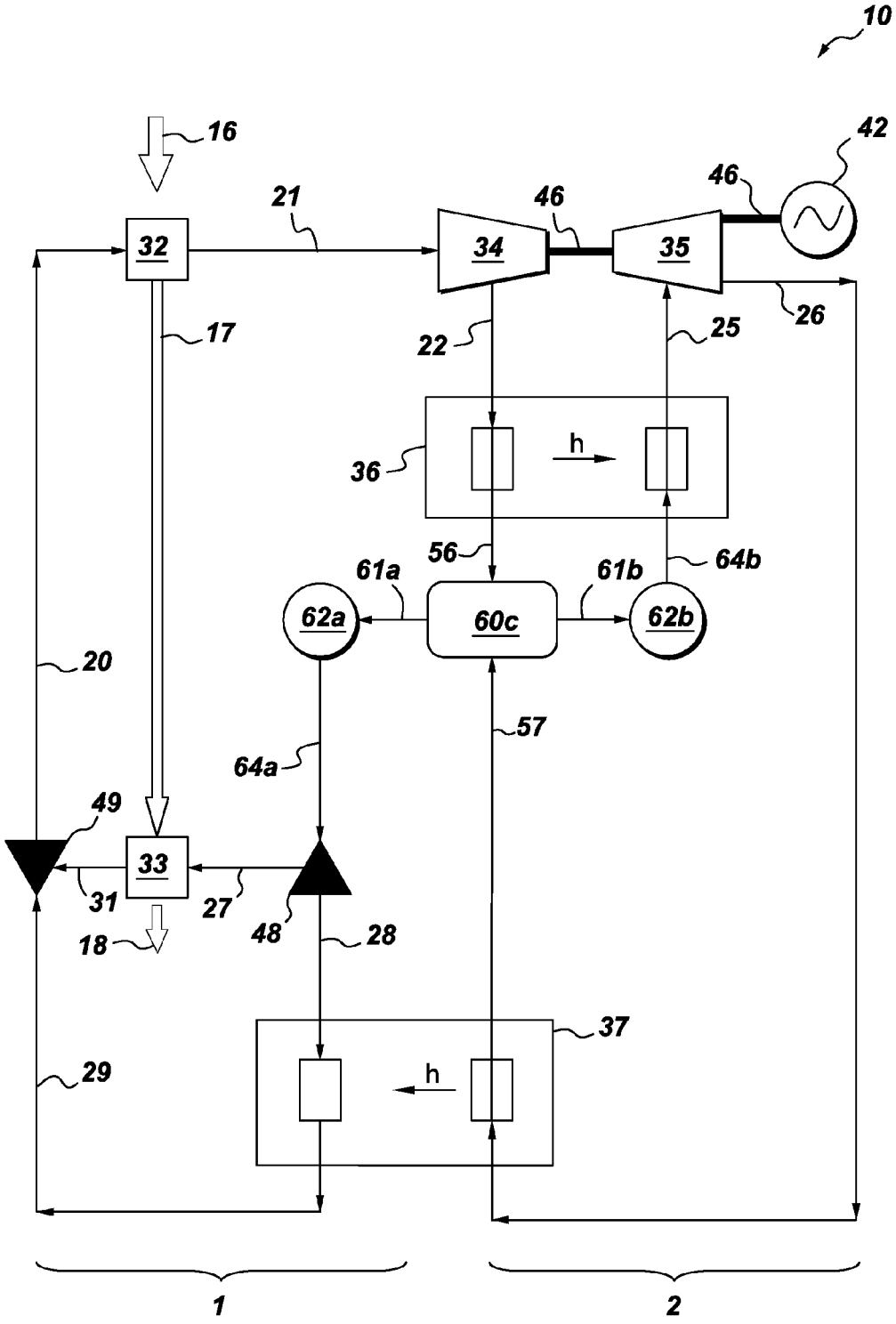
FIG. 6 represents a sixth embodiment of the present invention.

Referring to FIG. 6, the figure represents a Rankine cycle system configured as in FIG. 5 with the exception that the first condenser 60*a* of closed loop thermal energy recovery cycle 1 and second condenser 60*b* of closed loop thermal energy recovery cycle 2 are combined into a single condenser unit 60*c* configured to keep the first working fluid stream and the second working fluid stream separate while providing for a single means of heat removal, for example a single refrigeration unit configured to remove heat from both heat depleted first working fluid stream 56 and heat depleted second working fluid stream 57 without mixing the two streams. In one embodiment, condenser unit 60*c* comprises one or more flow channels through which heat depleted first working fluid stream 56 may flow while in thermal contact with a first refrigerant to produce chilled first working fluid stream 61*a*. Heat depleted second working fluid stream 57 is directed through an independent set of flow channels of condenser unit 60*c* where the second working fluid stream gives up additional heat to the first refrigerant and then exits condenser unit 60*c* as chilled second working fluid stream 61*b*. While formally combined into a single condenser unit 60*c*, each of the first closed loop thermal energy recovery cycle 1 and second closed loop thermal energy recovery cycle 2 is defined as comprising a condenser unit, at times herein referred to as a first condenser unit and a second condenser unit respectively.

Figure 7:
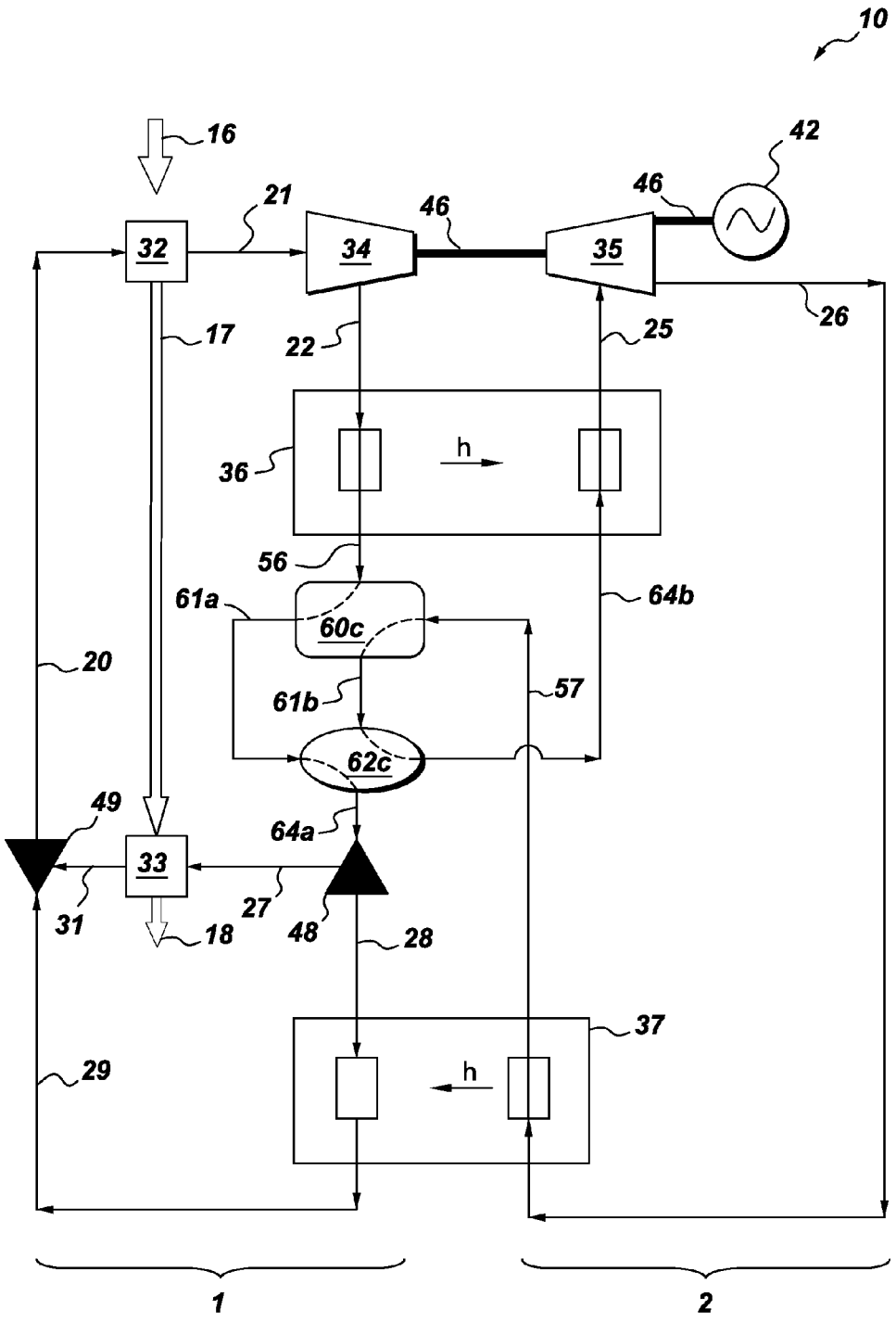
FIG. 7 represents a seventh embodiment of the present invention.

Referring to FIG. 7, the figure represents a Rankine cycle system configured as in FIG. 6 with the additional exception that the first pump 62*a* of first closed loop thermal energy recovery cycle 1 and the second pump 62*b* of second closed loop thermal energy recovery cycle 2 are combined in a single pumping unit 62*c* which is configured to pump both the first working fluid stream and the second working fluid stream without causing the two streams to mix. Such multichannel pumps capable of independently pumping two or more working fluids are known to those of ordinary skill in the art. In one embodiment, heat depleted first working fluid stream 56 is chilled in a first set of flow channels of consolidated condenser unit 60*c* to produce chilled first working fluid stream 61*a* which is introduced into a first pumping channel of consolidated pumping unit 62*c* where it is pressurized to produce pressurized first working fluid stream 64*a*. Simultaneously, heat depleted second working fluid stream 57 is independently chilled in a second set of flow channels of consolidated condenser unit 60*c* to produce chilled second working fluid stream 61*b* which is introduced into a second pumping channel of consolidated pumping unit 62*c* to produce pressurized second working fluid stream 64*b*. While formally combined into a single pumping unit 62*c*, each of the first closed loop thermal energy recovery cycle 1 and second closed loop thermal energy recovery cycle 2 is defined as comprising a pumping unit, at times herein referred to as a first pump and a second pump respectively.

Figure 8:
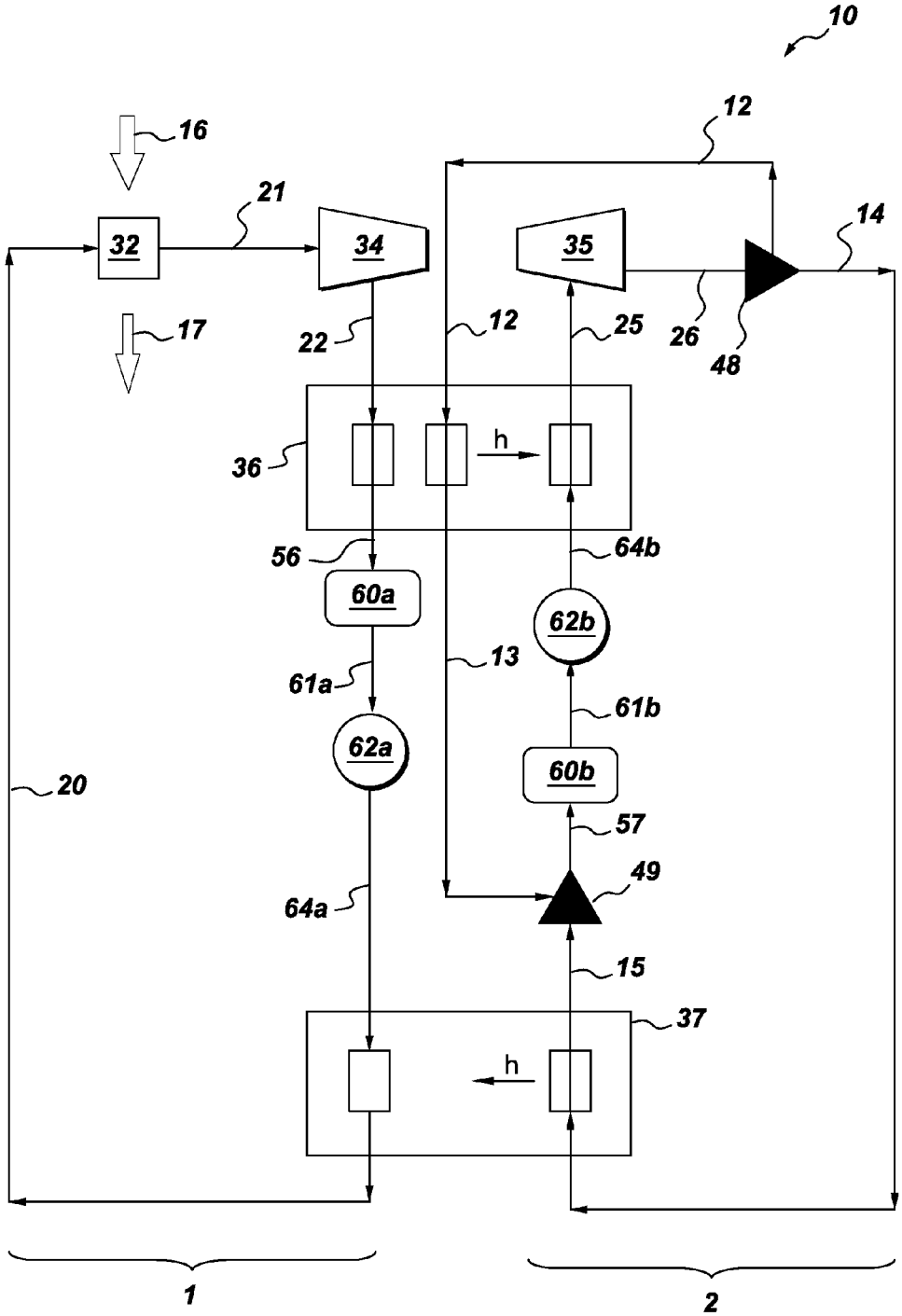
FIG. 8 represents an eighth embodiment of the present invention.

Referring to FIG. 8, the figure represents a Rankine cycle system 10 configured as in FIG. 1, with the exception that the second closed loop thermal energy recovery cycle has been modified by the addition of stream splitter 48 configured to split expanded second working fluid stream 26 into a first portion 12 and a second portion 14, and a working fluid stream combiner 49 configured to combine a heat depleted working fluid stream 13 (produced from first portion 12) with a heat depleted working fluid stream 15 (produced from second portion 14). In the embodiment shown, vaporized second working fluid stream 25 produced in first heat exchanger 36 is expanded in second expander 35 to produce expanded second working fluid stream 26, which is transformed by working fluid stream splitter 48 into first portion 12 and second portion 14. First portion 12 is directed back to first heat exchanger 36 where additional heat is extracted from first portion 12 by thermal contact with pressurized second working fluid stream 64*b* to produce heat depleted second working fluid stream 13 and vaporized second working fluid stream 25. Meanwhile, second portion 14 is directed to second heat exchanger 37 where it transfers heat to pressurized first working fluid stream 64*a* to produce thermally enhanced first working fluid stream 20 and heat depleted second working fluid stream.

Figure 9:
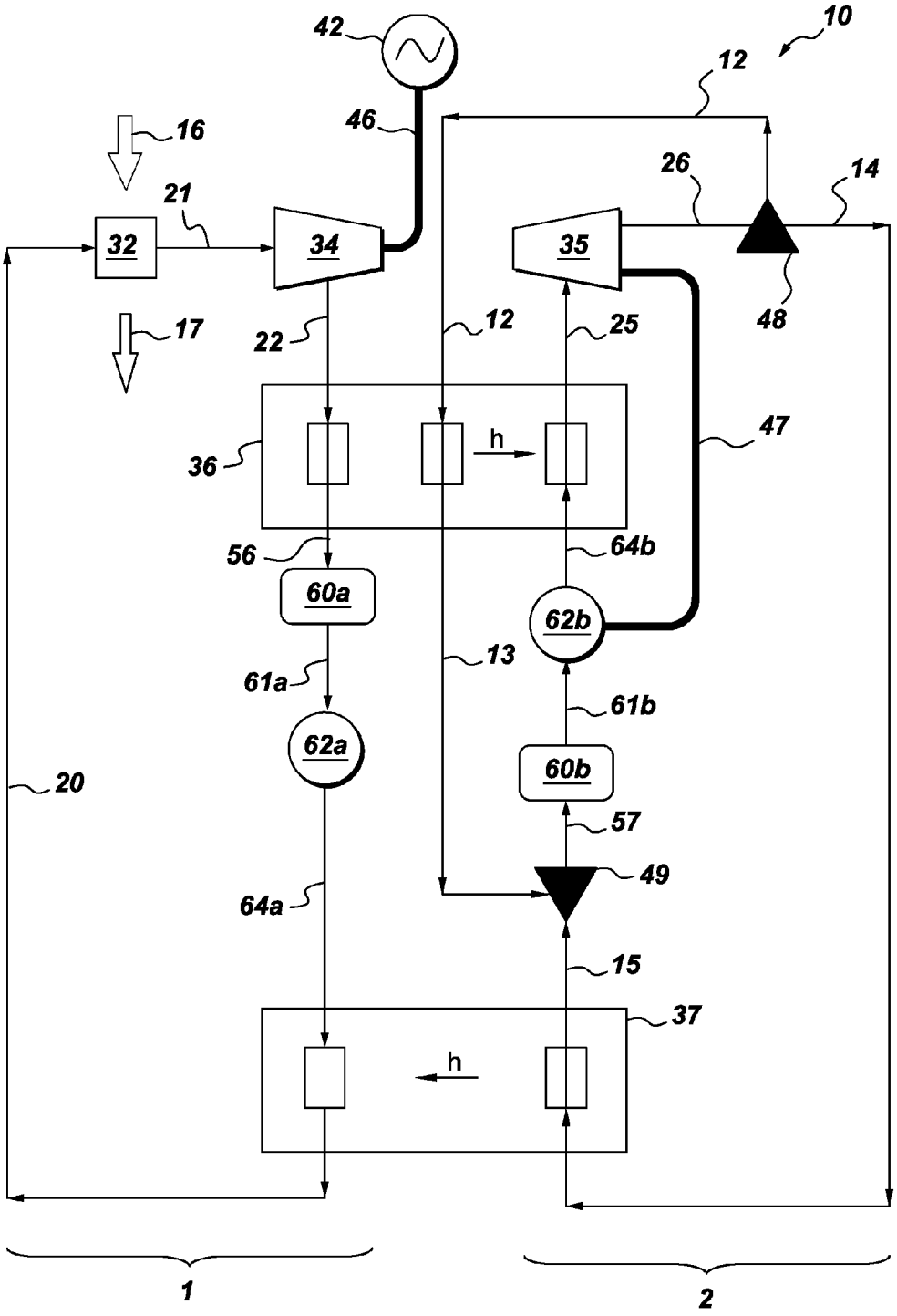
FIG. 9 represents a ninth embodiment of the present invention.

Referring to FIG. 9, the figure represents a Rankine cycle system 10 configured as in FIG. 8 with the addition of a mechanical energy conversion device 42 mechanically coupled to first expander 34. In addition, second expander is configured to drive second pump 62*b* via mechanical coupling 47.

Figure 10:
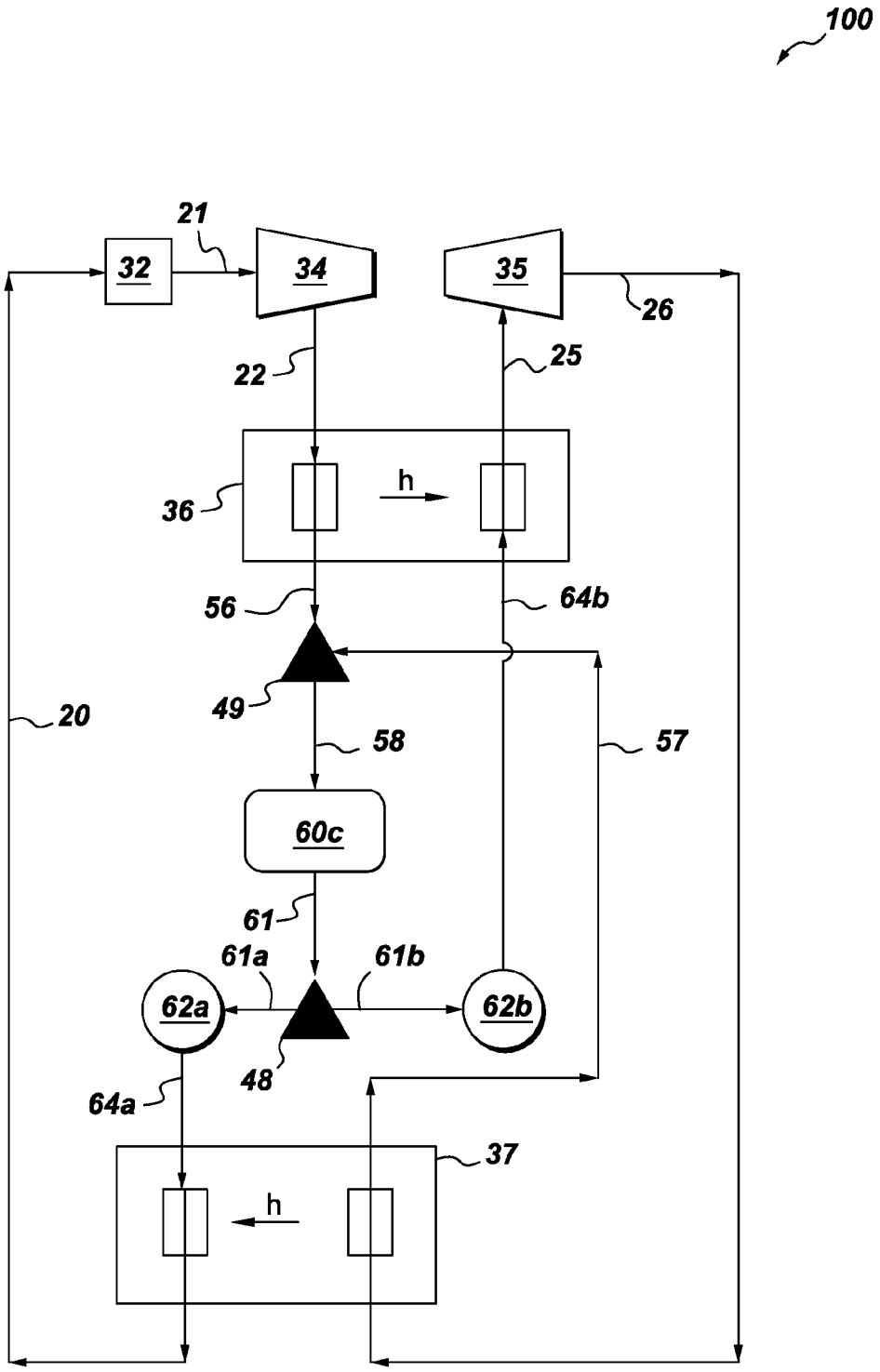
FIG. 10 represents a laboratory Rankine cycle system used in studies underlying the present invention.

Referring to FIG. 10, the figure represents a laboratory-scale Rankine cycle system 100 used in studies underlying the present invention. The system was built at the GE Global Research Center in Munich, Germany, and employed carbon dioxide as the working fluid, which was in a supercritical state in one or more locations within a single, closed loop thermal energy recovery cycle. The system was operated at temperatures in a range from about ambient temperature to about 550° C. at pressures in a range from about 50 to about 250 bar. The laboratory-scale Rankine cycle system comprised an electric heater 32 to produce vaporized first working fluid stream 21 at temperatures in a range between 500 and 550° C. and pressures in a range from about 200 to about 250 bar and flow rates in a range from about 200 to about 330 grams per second.

Under a first set of experimental conditions, the electric heater was operated to produce vaporized first working fluid stream at 524° C. and 250 bar at a flow rate of 280 grams per second. The laboratory-scale Rankine cycle system employed expansion valves 34 and 35 instead of expanders. The characteristics of the working fluid (temperature pressure and flow rate) before and after passage of the working fluid through an expansion valve were used to calculate the power output of the system. The expanded working fluid stream 22 emerged from first expansion valve 34 at a temperature in a range from about 350 to about 540° C. and a pressure in a range from about 50 to about 80 bar at a flow rate in a range from about 200 to about 330 grams per second. Under a first set of experimental conditions, the working fluid emerged from the first expansion valve at 512° C. and 80 bar at a flow rate of 280 grams per second. Expanded first working fluid stream 22 was presented to first heat exchanger 36 where it was contacted with a pressurized second working fluid stream 64*b* to produce a heat depleted first working fluid stream 56 and a second vaporized working fluid stream 25. The heat depleted working fluid stream 56 and was consolidated with heat depleted second working fluid stream 57 as described below. The second vaporized working fluid stream 25 emerged from first heat exchanger 36 at a temperature in a range from about 300 to about 490° C. and a pressure in a range from about 200 to about 250 bar at a flow rate in a range from about 200 to about 330 grams per second. Under a first set of experimental conditions, the vaporized second working fluid stream 25 emerged from the first heat exchanger at 489° C. and 250 bar at a flow rate of 220 grams per second.

Still referring to FIG. 10, second vaporized working fluid stream 25 was expanded through second expansion valve 35 to produce expanded second working fluid stream 26 at a temperature in a range from about 290 to about 480° C. and a pressure in a range from about 50 to about 80 bar at a flow rate in a range from about 200 to about 330 grams per second. Under a first set of experimental conditions, the expanded second working fluid stream 26 emerged from second expander 35 at 475° C. and 80 bar at a flow rate of 220 grams per second. Expanded second working fluid stream 26 was then presented to second heat exchanger 37 where it was brought into thermal contact with pressurized first working fluid stream 64*a* to produce heat depleted second working fluid stream 57 and a thermally enhanced first working fluid stream 20 which was returned to heater 32. Thermally enhanced first working fluid stream 20 was reintroduced to heater 32 at a temperature in a range from about 240 to about 430° C. and a pressure in a range from about 200 to about 250 bar at a flow rate in a range from about 200 to about 330 grams per second. Under a first set of experimental conditions, the thermally enhanced first working fluid stream 20 was reintroduced to heater 32 at 266° C. and 250 bar at a flow rate of 280 grams per second.

The heat depleted second working fluid stream 57 emerged from second heat exchanger 37 and was combined with heat depleted first working fluid stream 56 at working fluid stream combiner 49 to produce consolidated heat depleted working fluid stream 58 at a temperature in a range from about 80 to about 100° C. and a pressure in a range from about 50 to about 80 bar at a flow rate in a range from about 200 to about 650 grams per second. Under a first set of experimental conditions, the consolidated heat depleted working fluid stream 58 emerged from the working fluid stream combiner 48 at 82° C. and 80 bar at a flow rate of 500 grams per second.

Consolidated working fluid stream 58 was then introduced into condenser 60*c* where it was chilled to a temperature in a range from about 20 to about 40° C. and a pressure in a range from about 50 to about 80 bar at a flow rate in a range from about 200 to about 650 grams per second. Under a first set of experimental conditions, the chilled working fluid stream 61 emerged from the condenser at 30° C. and 80 bar at a flow rate of 500 grams per second.

Still referring to FIG. 10, chilled working fluid stream 61 was then divided at working fluid stream splitter 48 into two chilled working fluid streams 61*a* and 61*b* which were separately pressurized in first pump 62*a* and second pump 62*b*. The output of the first pump, pressurized first working fluid stream 64*a*, was presented to second heat exchanger 37 as described above. Under a first set of experimental conditions, the pressurized working fluid stream 64*a* emerged from first pump 62*a* at 59° C. and 250 bar at a flow rate of 280 grams per second. The output of the second pump, pressurized second working fluid stream 64*b*, was presented to the first heat exchanger 36 as described above. Under a first set of experimental conditions, the pressurized working fluid stream 64*b* emerged from second pump 62*b* at 59° C. and 250 bar at a flow rate of 220 grams per second.

Figure 11:
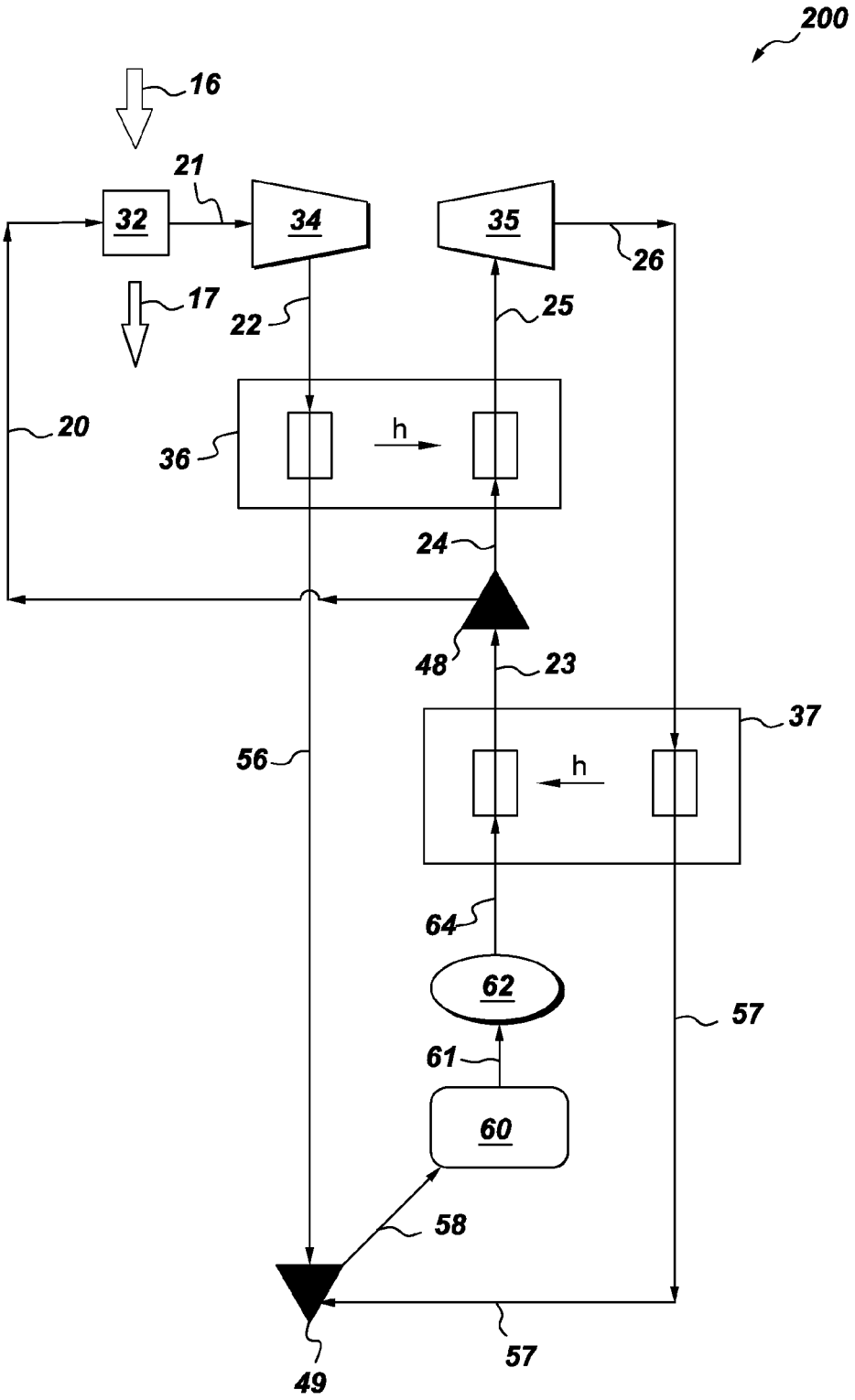
FIG. 11 represents an alternately configured Rankine cycle system of Comparative Example 1.

Referring to FIG. 11, the figure represents an alternate Rankine cycle system 200 of complexity comparable to that of the Rankine cycle systems of the present invention and comprising only one closed loop thermal energy recovery cycle. The Rankine cycle system is configured to heat a thermally enhanced first working fluid stream 20 with a first waste heat-containing stream 16 to produce thereby a second waste heat-containing stream 17 and a vaporized first working fluid stream 21, which is expanded in first expander 34 to produce mechanical energy and expanded first working fluid stream 22. Expanded first working fluid stream 22 is then introduced into first heat exchanger 36 in which heat is transferred from stream 22 to a second thermally enhanced working fluid stream 24, producing thereby heat depleted first working fluid stream 56 and vaporized second working fluid stream 25, which is expanded in second expander 35 to produce expanded second working fluid stream 26. Expanded second working fluid stream 26 is then introduced into second heat exchanger 37, in which heat is transferred from stream 26 to a consolidated pressurized working fluid stream 64 to produce a thermally enhanced consolidated working fluid stream 23, which is divided into working fluid streams 20 and 24 in working fluid stream splitter 48.

Still referring to FIG. 11, heat depleted second working fluid stream 57 exits second heat exchanger 37 and is consolidated with heat depleted first working fluid stream 56 in working fluid stream combiner 49 to provide consolidated heat depleted working fluid stream 58. Stream 58 is then chilled in condenser 60 to provide condensed working fluid stream 61, which is pressurized in pump 62 to produce consolidated pressurized working fluid stream 64.

Various Rankine cycle system components are well known to those of ordinary skill in the art, for example; working fluid stream splitters, working fluid stream combiners, working fluid pumps and working fluid condensers, and are commercially available.

In addition to providing Rankine cycle systems, the present invention provides a method of recovering thermal energy using a Rankine cycle system. One or more embodiments the method are illustrated by FIGS. 1-9. Thus in one embodiment, the method comprises: (a) transferring heat from a first waste heat-containing stream to a first working fluid stream contained within a first closed loop thermal energy recovery cycle to produce thereby a vaporized first working fluid stream and a second waste heat-containing stream; (b) expanding the vaporized first working fluid stream to produce thereby mechanical energy and an expanded first working fluid stream; (c) transferring heat from the expanded first working fluid stream to a second working fluid stream contained within a second closed loop thermal energy recovery cycle to produce thereby a vaporized second working fluid stream and a heat depleted first working fluid stream; (d) expanding the vaporized second working fluid stream to produce thereby mechanical energy and an expanded second working fluid stream; and (e) transferring heat from the expanded second working fluid stream to a chilled first working fluid stream, to produce thereby a thermally enhanced first working fluid stream and a second heat depleted second working fluid stream.

In one embodiment of the method, at least one of the first working fluid and the second working fluid is carbon dioxide in a supercritical state during at least a portion of at least one method step.

In one embodiment of the method, both the first working fluid and the second working fluid are carbon dioxide.

In one embodiment of the method at least one of the first working fluid and the second working fluid is in a supercritical state during at least a portion of at least one of method steps (a)-(e).

In one or more embodiments, the methods and systems provided by the present invention may be used to capture and utilize heat from a waste heat-containing stream which is an exhaust gas stream produced by a combustion turbine.

EXPERIMENTAL PART

A laboratory-scale Rankine cycle system was constructed and tested in order to demonstrate both the operability of a supercritical carbon dioxide Rankine cycle system and to verify performance characteristics of individual components of the Rankine cycle system suggested by their manufacturers, for example the effectiveness of the printed circuit heat exchangers. The experimental Rankine cycle system was a single closed loop thermal energy recovery cycle configured as shown in FIG. 10 herein. The performance characteristics of the laboratory-scale Rankine cycle system were used to predict the performance characteristics of the Rankine cycle systems provided by the present invention. Comparing the laboratory-scale Rankine cycle system shown in FIG. 10 with the Rankine cycle system provided by the present invention as shown in FIG. 1 the following should be noted: first expander 34 and second expander 35 are replaced by expansion valves 34 and 35, heat depleted working fluid streams 56 and 57 are combined in a working fluid stream combiner 49 to provide a consolidated heat depleted working fluid stream 58 which is chilled in consolidated condenser unit 60*c*. The output of condenser unit 60*c*, chilled working fluid stream 61, is divided into chilled working fluid streams 61*a* and 61*b* at working fluid stream splitter 48, and are fed to pumps 62*a* and 62*b* respectively to provide pressurized, chilled working fluid streams 64*a* and 64*b* respectively. The laboratory-scale Rankine cycle system did not employ a first waste heat-containing stream 16 and relied instead on electric heating elements to heat the first working fluid stream 20. The working fluid was carbon dioxide. The incremental effect of transferring heat either from the second waste heat-containing stream 17 or a thermally enhanced second waste heat-containing stream to the first heat exchanger 36 may be approximated by adding heating elements to heat exchanger 36. The experimental system provided a framework for additional simulation studies discussed below. In particular, data obtained experimentally could be used to confirm and/or refine the predicted performance of embodiments of the present invention.

Two software models were employed to predict the performance of Rankine cycle systems provided by the present invention. The first of these software models "EES" (Engineering Equation Solver) available from F-Chart Software (Madison, Wis.), is an equation-based computational system that allowed the predictive optimization of Rankine cycle system operating conditions as evidenced at system state points for best overall performance. Further insights into how best to operate the Rankine cycle system were obtained using Aspen HYSYS, a comprehensive process modeling system available from AspenTech.

Three embodiments of Rankine cycle systems provided by the present invention and configured respectively as in as in FIG. 1, FIG. 8, and FIG. 5 were evaluated (Examples 1-3) using an EES software model using the Spann-Wagner equation of state for carbon dioxide. The three embodiments (Examples 1-3) for which data are provided in Table 1, are thermodynamically equivalent to three alternate Rankine cycle system configurations disclosed in the inventors' United States patent applications having Ser. Nos. 13/905,923, 13/905,897 and 13/905,511 referenced in the first paragraph of this disclosure and incorporated by reference herein. Thus, Example 1 in Table 1 herein is thermodynamically equivalent to Comparative Example 3 in each of the referenced patent applications. Example 2 of Table 1 herein is thermodynamically equivalent to Example 1 of United States patent application having Ser. No. 13/905,897. Example 3 of Table 1 herein is thermodynamically equivalent to Example 1 of United States patent application having Ser. No. 13/905,923. The Rankine cycle systems of Examples 1-3 were compared with two other Rankine cycle systems. The first (Comparative Example 1) was a Rankine cycle system of similar complexity and configured as shown in FIG. 11, such that a consolidated working fluid stream 64 was presented to second heat exchanger 37, and thereafter, thermally enhanced working fluid stream 23 exiting second heat exchanger 37 was transformed by working fluid stream splitter 48 into first portion (working fluid stream 20) and a second portion 23. The Rankine cycle system of Comparative Example 2 comprised a single expander, and a single heat exchanger but was scaled appropriately so that a meaningful comparisons with Examples 1-3 and Comparative Example 1 could be made. The data presented in Table 1 illustrate the advantages of the Rankine cycle systems provided by the present invention relative to alternate Rankine cycle system configurations.

The Rankine cycle systems of Examples 1-3 and Comparative Examples 1-2 were modeled under a set of sixteen different steady state conditions, each steady state being characterized by a lowest system $CO_2$ working fluid temperature which varied from about 10° C. in the first steady state to about 50° C. in the sixteenth steady state. The predicted performance of the Rankine cycle systems depended on the ambient temperature and was also subject to a minimum allowable temperature for the waste heat-containing stream as it exits the system of about 130° C. This lower temperature limit is consistent with typical design guidelines for waste-heat recovery from the exhaust streams of combustion engines such as gas turbines, serving to prevent the condensation of corrosive acid gas within the exhaust duct. The power output of the model Rankine cycle systems could also be estimated using experimentally measured state points using the laboratory-scale Rankine cycle system as input for the computer simulation tool. The power output of each of the Rankine cycle systems studied fell steadily as the lowest system $CO_2$ working fluid temperature increased.

TABLE 1

Examples 1-3 versus Comparative Examples 1-2

| Lowest $CO_2$ Temp ° C. | Example 1 Power Output (kW) | Example 2 Power Output (kW) | Example 3 Power Output (kW) | Comparative Example 1 Power Output (kW) | Comparative Example 2 Power Output (kW) |
|---|---|---|---|---|---|
| 12.76 | 7083 | 7008 | 7083 | 6652 | 6571 |
| 14.14 | 7041 | 6903 | 7041 | 6588 | 6438 |
| 16.9 | 6955 | 6854 | 6955 | 6456 | 6167 |
| 19.66 | 6865 | 6769 | 6865 | 6317 | 5889 |
| 22.41 | 6773 | 6682 | 6773 | 6171 | 5604 |
| 25.17 | 6675 | 6590 | 6675 | 6018 | 5309 |
| 26.55 | 6624 | 6542 | 6624 | 5938 | 5156 |
| 29.31 | 6420 | 6440 | 6505 | 5769 | 4827 |
| 32.07 | 6062 | 6308 | 6371 | 5566 | 4453 |
| 34.83 | 5713 | 5970 | 6232 | 5336 | 4113 |
| 37.59 | 5381 | 5632 | 6091 | 5044 | 3811 |
| 38.97 | 5222 | 5467 | 6022 | 4893 | 3674 |
| 41.72 | 4920 | 5150 | 5890 | 4610 | 3425 |
| 44.48 | 4641 | 4853 | 5762 | 4352 | 3208 |
| 47.24 | 4386 | 4578 | 5638 | 4119 | 3025 |
| 50 | 4156 | 4327 | 5517 | 3912 | 2877 |

Comparison with Comparative Examples 1 and 2

| Lowest $CO_2$ Temp ° C. | Example 1 Advantage* over Comparative Example 1 | Example 2 Advantage* over Comparative Example 1 | Example 3 Advantage* over Comparative Example 1 | Example 1 Advantage* over Comparative Example 2 | Example 2 Advantage* over Comparative Example 2 | Example 3 Advantage* over Comparative Example 2 |
|---|---|---|---|---|---|---|
| 12.76 | 6.5% | 5.4% | 6.5% | 7.8% | 6.7% | 7.8% |
| 14.14 | 6.9% | 4.8% | 6.9% | 9.4% | 7.2% | 9.4% |
| 16.9 | 7.7% | 6.2% | 7.7% | 12.8% | 11.1% | 12.8% |
| 19.66 | 8.7% | 7.2% | 8.7% | 16.6% | 14.9% | 16.6% |
| 22.41 | 9.8% | 8.3% | 9.8% | 20.9% | 19.2% | 20.9% |
| 25.17 | 10.9% | 9.5% | 10.9% | 25.7% | 24.1% | 25.7% |
| 26.55 | 11.6% | 10.2% | 11.6% | 28.5% | 26.9% | 28.5% |
| 29.31 | 11.3% | 11.6% | 12.8% | 33.0% | 33.4% | 34.8% |
| 32.07 | 8.9% | 13.3% | 14.5% | 36.1% | 41.7% | 43.1% |
| 34.83 | 7.1% | 11.9% | 16.8% | 38.9% | 45.1% | 51.5% |
| 37.59 | 6.7% | 11.7% | 20.8% | 41.2% | 47.8% | 59.8% |
| 38.97 | 6.7% | 11.7% | 23.1% | 42.1% | 48.8% | 63.9% |
| 41.72 | 6.7% | 11.7% | 27.8% | 43.6% | 50.4% | 72.0% |
| 44.48 | 6.6% | 11.5% | 32.4% | 44.7% | 51.3% | 79.6% |
| 47.24 | 6.5% | 11.1% | 36.9% | 45.0% | 51.3% | 86.4% |
| 50 | 6.2% | 10.6% | 41.0% | 44.5% | 50.4% | 91.8% |

Example 1 configured as in FIG. 1;
Example 2 configured as in FIG. 8;
Example 3 configured as in FIG. 5;
Comparative Example 1 configured as in FIG. 11,
Comparative Example 2 = basic Rankine cycle configuration
*Example 1-3 Advantage relative to Comparative Examples 1 and 2 calculated as follows: (Example Power Output Value − Comparative Example Power Output Value)/Comparative Example Power Output Value.

The data presented in Table 1 show a significant improvement in power output of the Rankine cycle system provided by the present invention relative to a baseline, standard Rankine cycle configuration (Comparative Example 2) and alternately configured Rankine cycle system of similar complexity (Comparative Example 1).

The foregoing examples are merely illustrative, serving to illustrate only some of the features of the invention. The appended claims are intended to claim the invention as broadly as it has been conceived and the examples herein presented are illustrative of selected embodiments from a manifold of all possible embodiments. Accordingly, it is Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of:" Where necessary, ranges have been supplied, those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

What is claimed is:

1. A Rankine cycle system comprising:

(a) a first closed loop thermal energy recovery cycle comprising a first working fluid stream;

(b) a second closed loop thermal energy recovery cycle comprising a second working fluid stream;

(c) a first heat exchanger configured to transfer heat from the first working fluid stream to the second working fluid stream;

(d) a second heat exchanger configured to transfer heat from the second working fluid stream to the first working fluid stream;

wherein the first closed loop thermal energy recovery cycle further comprises:

(i) a heater configured to transfer heat from a first waste heat-containing stream to the first working fluid stream to produce a vaporized first working fluid stream and a second waste heat-containing stream;

(ii) a first expander configured to receive the vaporized first working fluid stream and to produce therefrom mechanical energy and an expanded first working fluid stream;

(iii) a first condenser configured to cool a heat depleted first working fluid stream and produce therefrom a chilled first working fluid stream; and (iv) a pump configured to pressurize the chilled first working fluid stream;

wherein the second closed loop thermal energy recovery cycle further comprises:

(v) a second expander configured to expand a vaporized second working fluid stream and to produce therefrom mechanical energy and an expanded second working fluid stream;

(vi) a second condenser configured to cool a heat depleted second working fluid stream and to produce therefrom a chilled second working fluid stream;

(vii) a pump configured to pressurize the chilled second working fluid stream;

(viii) a second-working-fluid-stream splitter configured to divide the expanded second working fluid stream into a first portion of the expanded second working fluid stream and a second portion of the expanded second working fluid stream; and (ix) a second-working-fluid-stream combiner configured to combine a heat depleted first portion of the second working fluid stream with a heat depleted second portion of the second working fluid stream;

wherein the first heat exchanger is configured to produce the vaporized second working fluid stream, the heat depleted first working fluid stream and the heat depleted first portion of the second working fluid stream; and wherein the second heat exchanger is configured to produce a thermally enhanced first working fluid stream and the heat depleted second portion of the second working fluid stream.

2. The Rankine cycle system according to claim 1, further comprising a generator.

3. The Rankine cycle system according to claim 1, further comprising a generator mechanically coupled to the first expander and the second expander.

4. The Rankine cycle system according to claim 1, wherein the first working fluid and the second working fluid are essentially identical.

5. The Rankine cycle system according to claim 1, wherein the system is configured to accommodate supercritical carbon dioxide.

6. The Rankine cycle system according to claim 1, wherein both the first working fluid and the second working fluid are carbon dioxide.

7. The Rankine cycle system according to claim 1, wherein the first condenser and the second condenser are incorporated into a single condenser unit.

8. The Rankine cycle system according to claim 1, wherein the first pump and the second pump are incorporated into a single pump unit.

9. The Rankine cycle system according to claim 1, wherein the first closed loop thermal energy recovery cycle further comprises a working fluid stream splitter.

10. The Rankine cycle system according to claim 1, wherein the first closed loop thermal energy recovery cycle further comprises a working fluid stream splitter and a second heater.

11. The Rankine cycle system according to claim 1, further comprising a second heater.

12. The Rankine cycle system according to claim 1, comprising at least one plate-fin condenser.

13. The Rankine cycle system according to claim 1, comprising at least one printed circuit condenser.

14. The Rankine cycle system according to claim 1, wherein at least one of the first expander and the second expander is configured to drive at least one of, the first pump and the second pump.

15. The Rankine cycle system according to claim 1, further comprising a generator configured to be driven by the first expander and at least one of, the first pump and the second pump configured to be driven by the second expander.

16. The Rankine cycle system according to claim 2, wherein the generator is mechanically coupled to the first expander.

17. The Rankine cycle system according to claim 2, wherein the generator is mechanically coupled to the second expander.

18. The Rankine cycle system according to claim 3, wherein the first expander and the second expander, share a common drive shaft.

* * * * *